US011667998B2

(12) United States Patent
Watanabe et al.

(10) Patent No.: US 11,667,998 B2
(45) Date of Patent: Jun. 6, 2023

(54) MAGNETIC MATERIAL COMPRISING FE—NI ORDERED ALLOY AND METHOD FOR MANUFACTURING THE SAME

(71) Applicant: DENSO CORPORATION, Kariya (JP)

(72) Inventors: Eiji Watanabe, Kariya (JP); Yuta Saiga, Kariya (JP); Hidehiko Hiramatsu, Kariya (JP); Sho Goto, Kariya (JP); Ryota Shinozaki, Kariya (JP); Hiroaki Kura, Kariya (JP)

(73) Assignee: DENSO CORPORATION, Kariya (JP)

( * ) Notice: Subject to any disclaimer, the term of this patent is extended or adjusted under 35 U.S.C. 154(b) by 541 days.

(21) Appl. No.: 16/674,132

(22) Filed: Nov. 5, 2019

(65) Prior Publication Data

US 2020/0071811 A1 Mar. 5, 2020

Related U.S. Application Data

(63) Continuation of application No. PCT/JP2018/019169, filed on May 17, 2018.

(30) Foreign Application Priority Data

May 17, 2017 (JP) ..... JP2017-098304
Apr. 12, 2018 (JP) ..... JP2018-077090

(51) Int. Cl.
*C23C 8/26* (2006.01)
*C22C 38/08* (2006.01)
(Continued)

(52) U.S. Cl.
CPC ..... *C23C 8/26* (2013.01); *C22C 38/001* (2013.01); *C22C 38/08* (2013.01); *H01F 1/047* (2013.01); *C22C 2202/02* (2013.01)

(58) Field of Classification Search
CPC ..... B22F 2207/00; B22F 2301/00; B22F 2301/15; B22F 2301/35; B22F 2302/00;
(Continued)

(56) References Cited

U.S. PATENT DOCUMENTS

2013/0228716 A1* 9/2013 Suetsuna ..... H01F 1/01 427/127
2014/0210581 A1* 7/2014 Lewis ..... C22C 30/00 148/101
(Continued)

FOREIGN PATENT DOCUMENTS

JP 2006-183096 A 7/2006
JP 5892662 B2 3/2016
(Continued)

OTHER PUBLICATIONS

"Glossary of Metallurgical and Metalworking Terms," Metals Handbook, ASM Handbooks Online, ASM International, 2002, pp. 1, 12, 257. (Year: 2002).*
(Continued)

*Primary Examiner* — Vanessa T. Luk
(74) *Attorney, Agent, or Firm* — Posz Law Group, PLC

(57) ABSTRACT

An FeNi ordered alloy contained in a magnetic material has an $L1_0$ ordered structure, is doped with an light element, and is provided as a granular particle. A method for manufacturing a magnetic material including an FeNi ordered alloy having an $L1_0$ ordered structure includes preparing an FeNi ordered alloy provided as a granular particle, and doping a light element into the FeNi ordered alloy.

9 Claims, 9 Drawing Sheets

(51) Int. Cl.
*H01F 1/047* (2006.01)
*C22C 38/00* (2006.01)

(58) Field of Classification Search
CPC ..... B22F 2302/05; B22F 2302/10; B22F 2302/15; B22F 2302/20; B22F 2302/35; B22F 2302/40; B22F 2302/403; B22F 2302/45; B22F 2302/205; C22C 19/00; C22C 19/03; C22C 19/007; C22C 28/00; C22C 30/00; C22C 2200/00; C22C 2200/04; C22C 2200/06; C22C 2202/02; H01F 1/00; H01F 1/01; H01F 1/03; H01F 1/032; H01F 1/04; H01F 1/06; H01F 1/068; H01F 1/047
See application file for complete search history.

(56) References Cited

U.S. PATENT DOCUMENTS

2014/0271324 A1* 9/2014 Pinkerton ..... B22F 9/14 75/346
2017/0250024 A1* 8/2017 Lewis ..... H01F 41/0253
2018/0044768 A1 2/2018 Makino
2018/0251867 A1 9/2018 Kura et al.

FOREIGN PATENT DOCUMENTS

WO WO-2016036856 A1 * 3/2016 ..... B22F 1/0018
WO WO-2016171232 A1 * 10/2016 ..... C21D 6/001

OTHER PUBLICATIONS

Makino et al., "Artificially produced rare-earth free cosmic magnet," Scientific Reports 5, Article No. 16627, 2015, pp. 1-8.
Kaptay et al., "Electrochemical synthesis of refractory borides from molten salts," Plasmas & Ions, vol. 2, Issue 2, 1999, pp. 45-56.
Zhong-Ning et al., "Electrochemical behaviors of Mg2+ and B3+ deposition in fluoride molten salts," Transactions of Nonferrous Metals Society of China, vol. 21, Issue 7, 2011, pp. 1655-1659.
Kellner, "Electrodeposition of Coherent Boron," Journal of The Electrochemical Society, vol. 120, Issue 6, Jun. 1973, pp. 713-716.
Ono et al., "Local structure evaluation on synthesis reaction process of FeNi superlattice," Chiba Tech. Univ. Shin-Narashino Campus, Spring 2018 (162nd) Lecture Meeting, Mar. 19-21, 2018 (and English translation).
Ono et al., "Local structure evaluation on synthesis reaction process of FeNi superlattice," Nagoya International Center Annex Building Hall, 6th Aichi Synchrotron Light Center Business Results Presentation, Mar. 23, 2018 (and English translation).
U.S. Appl. No. 16/672,865, filed Nov. 4, 2019, Kura et al.
U.S. Appl. No. 16/677,755, filed Nov. 8, 2019, Saiga et al.
U.S. Appl. No. 16/678,344, filed Nov. 8, 2019, Goto et al.

* cited by examiner

FIG. 7

| | DOPANT | GAS NITRIDING | ELECTROCHEMICAL TREATMENT | TREATMENT TIME [h] | SATURATION MAGNETIZATION (T) | COERCIVITY (kA/m) |
|---|---|---|---|---|---|---|
| WORKING EX. 1 | B | NO | $LiCl-KCl-CsCl-KBF_4$ | 20 | 1.2 | 88 |
| WORKING EX. 2 | C | NO | $LiCl-KCl-CsCl-K_2CO_3$ | 20 | 1.2 | 95 |
| WORKING EX. 3 | N | YES | — | 4 | 1.1 | 105 |
| WORKING EX. 4 | N | NO | $LiCl-KCl-CsCl-Li_3N$ | 20 | 1.0 | 101 |
| WORKING EX. 5 | B, C | NO | $LiCl-KCl-CsCl-KBF_4-K_2CO_3$ | 20 | 1.2 | 96 |
| WORKING EX. 6 | C, N | YES | $LiCl-KCl-CsCl-K_2CO_3$ | 20 | 1.1 | 99 |
| WORKING EX. 7 | N, B | YES | $LiCl-KCl-CsCl-KBF_4$ | 20 | 1.0 | 110 |
| WORKING EX. 8 | B, C, N | YES | $LiCl-KCl-CsCl-KBF_4-K_2CO_3$ | 20 | 1.0 | 114 |
| COMPARATIVE EX. 1 | — | — | — | — | 1.4 | 72 |

FIG. 8A

| | B | Fe | Ni | SUM |
|---|---|---|---|---|
| MEASURED POINT (1) | 58 | 22 | 20 | 100 |
| MEASURED POINT (2) | 70 | 15 | 15 | 100 |
| MEASURED POINT (3) | 65 | 17 | 18 | 100 |
| MEASURED POINT (4) | 59 | 21 | 20 | 100 |

FIG. 8B

| | C | Fe | Ni | SUM |
|---|---|---|---|---|
| WORKING EX. 2 | 39 | 28 | 33 | 100 |

FIG. 8C

| | N | Fe | Ni | SUM |
|---|---|---|---|---|
| WORKING EX. 3 | 43 | 26 | 31 | 100 |

FIG. 8D

| | B | Fe | Ni | SUM |
|---|---|---|---|---|
| COMPARATIVE EX. 1 | 0 | 51 | 49 | 100 |

MAGNETIC MATERIAL COMPRISING FE—NI ORDERED ALLOY AND METHOD FOR MANUFACTURING THE SAME

CROSS REFERENCES TO RELATED APPLICATIONS

The present application is a continuation application of international Patent Application No PCT/JP2018/019169 filed on May 17, 2018, which designated the U.S. and claims the benefit of priorities from Japanese Patent Application No. 2017-98304 filed on May 17, 2017 and Japanese Patent Application No. 2018-77090 filed on Apr. 12, 2018. The entire disclosures of all of the above applications are incorporated herein by reference.

TECHNICAL FIELD

The present disclosure relates to a magnetic material comprising an $L1_0$-FeNi ordered alloy having an $L1_0$ ordered structure, and to a manufacturing method for the same.

BACKGROUND

An FeNi ordered alloy of $L1_0$ type comprising Fe (iron) and Ni (nickel) as its main components is expected to be a promising magnet material and a promising magnetic recording material for which no rare earth element and no noble metal are used at all. Here, the $L1_0$ ordered structure is a crystal structure which has a face-centered cubic lattice as its basic structure and in which Fe and Ni are layered in the (001) direction.

SUMMARY

The present disclosure provides a magnetic material comprising an $L1_0$-FeNi ordered alloy and a manufacturing method for the same.

In an aspect of the present disclosure, a magnetic material comprises an FeNi ordered alloy having an $L1_0$ ordered structure, doped with an light element, and provided as a granular particle.

In an aspect of the present disclosure, a method for manufacturing a magnetic material comprising an FeNi ordered alloy having an $L1_0$ ordered structure comprises: preparing an FeNi ordered alloy provided as a granular particle; and doping a light element into the FeNi ordered alloy.

BRIEF DESCRIPTION OF DRAWINGS

FIG. 7 is a diagram showing conditions in a doping process of a respective working example, and measurement results of saturation magnetization and coercivity of a respective working example and a comparative example.

FIG. 8A is a diagram showing a measurement result of a dope ratio in a sample of working example 1.

FIG. 8B is a diagram showing a measurement result of a dope ratio in a sample of working example 2.

FIG. 8C is a diagram showing a measurement result of a dope ratio in a sample of working example 3.

FIG. 8D is a diagram showing a measurement result of a dope ratio in a sample of comparative example 3.

DETAILED DESCRIPTION

Figure 1A:
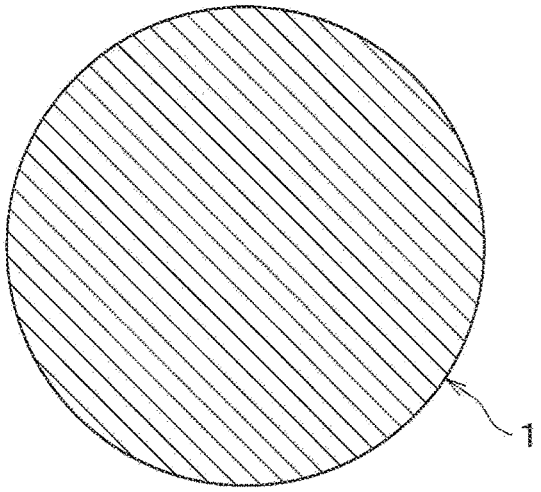
FIG. 1A is a diagram showing a cross sectional structure of a granular particle of an FeNi ordered alloy contained in a magnetic material illustrated in a first embodiment.

An FeNi ordered alloy of $L1_0$ type comprising Fe (iron) and Ni (nickel) as its main components is expected to be a promising magnet material and a promising magnetic recording material for which no rare earth element and no noble metal are used at all. Here, the $L1_0$ ordered structure is a crystal structure which has a face-centered cubic lattice as its basic structure and in which Fe and Ni are layered in the (001) direction. Such an $L1_0$ ordered structure is found in alloys such as FePt, FePd and AuCu and is typically obtainable by thermally treating a random alloy at an order-disorder transition temperature Tλ or smaller and promoting the diffusion.

In order to use a magnetic material comprising this $L1_0$-FeNi ordered alloy for a magnet material or a magnetic recording material, a large coercivity is required. There is a proposed technology which proposes quenching crystallization of the $L1_0$-FeNi ordered alloy in order to obtain a large coercivity in the $L1_0$-FeNi ordered alloy. By using this manufacturing method, it is possible to obtain the $L1_0$-FeNi ordered alloy having the coercivity of 56 [kA/m]. It is reported that the FeNi ordered alloy obtained in this way also has high order degrees not throughout it but locally, and has magnetization of 100 [emu/g] and a volume fraction of roughly 8 [%].

The use of the magnetic material comprising the Fe—Ni ordered alloy for the magnet material or the magnetic recording material requires a large coercivity, specifically, 87.5 [kA/m] or more. The coercivity may be obtained as follows: the magnetic field is applied to the obtained Fe—Ni ordered alloy and the coercivity is obtained as the magnitude of magnetic field at which a magnetization direction of the Fe—Ni ordered alloy is changed over due to the magnetic field. In the SI units system, the coercivity is expressed in units of kA/m. In the OGS units system, the coercivity is expressed in units of Oe [Oersted]. Thus, 1 [A/m]=$4\pi\times10^{-3}$ [Oe] and 87.5 [kA/m]=1100 [Oe] are satisfied.

The use of the magnetic material comprising the Fe—Ni ordered alloy for the magnet material or the magnetic recording material requires not only the large coercivity but also a large saturation magnetization. Specifically, the large saturation magnetization of 1.0 [T] or more is required.

In this regard, the saturation magnetization and the coercivity involve such a trade-off relationship therebetween that the coercivity decreases as the saturation magnetization increases, and inversely, the coercivity increases as the saturation magnetization decreases. Therefore, it is desired to realize both the large coercivity and the large saturation magnetization while enabling control of the coercivity and the saturation magnetization.

An object of the present disclosure is to provide a magnetic material comprising an $L1_0$-FeNi ordered alloy and a manufacturing method for the same which enable control of coercivity and saturation magnetization and which realize both a large coercivity and a large saturation magnetization.

A magnetic material in an aspect of the present disclosure comprises an FeNi ordered alloy having an $L1_0$ ordered structure, doped with an light element, and provided as a granular particle.

As described, the FeNi ordered alloy contained in the magnetic material is provided as the granular particle and doped with the light element. This structure makes it possible to provide the magnetic material with the FeNi ordered alloy having a coercivity of 87.5 [kA/m] or more and a saturation magnetization of 1.0 [T] or more.

A method for manufacturing a magnetic material comprising an FeNi ordered alloy having an $L1_0$ ordered structure in an aspect of the present disclosure comprises: preparing an FeNi ordered alloy provided as a granular particle; and doping a light element into the FeNi ordered alloy.

By preparing the FeNi ordered alloy as the granular particle and then doping the light element into the FeNi ordered alloy in the above way, it is possible to provide the magnetic material with the FeNi ordered alloy having the coercivity of 87.5 [kA/m] or more and the saturation magnetization of 1.0 [T] or more.

Embodiments of the present disclosure will be described below with reference to the drawings. In the following embodiments, the description will be given while the same reference numerals are assigned to same or equivalent parts.

First Embodiment

A first embodiment will be described. The $L1_0$-FeNi ordered alloy according to the present embodiment, that is, a magnetic material comprising an FeNi superlattice is applied to a magnet material, a magnetic recording material, or the like.

The $L1_0$-FeNi ordered alloy contained in the magnetic material according to the present embodiment is a granular particle, doped with a light element, has a coercivity of 87.5 kA/m or more, and a saturation magnetization of 1.0 [T] or more. Specifically, the $L1_0$-FeNi ordered alloy is doped with, for example, B (boron), C (carbon), and N (nitrogen) as light elements, or may be doped with at least one of a plurality of types or two or more of the light elements.

Figure 1B:
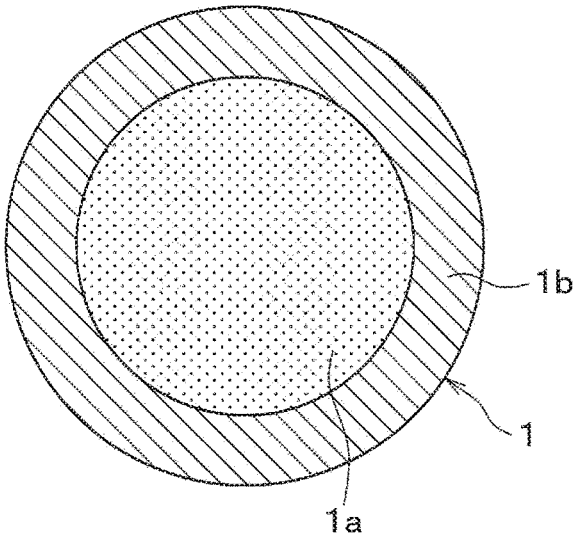
FIG. 1B is a diagram showing a cross sectional structure of a granular particle of an FeNi ordered alloy contained in a magnetic material illustrated in a first embodiment.
Figure 1C:
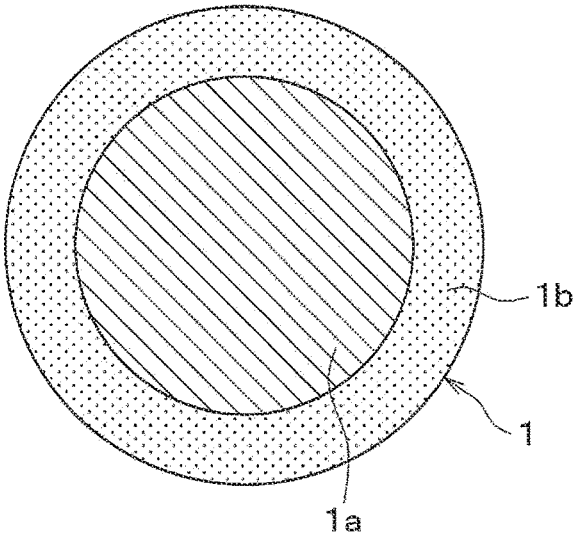
FIG. 1C is a diagram showing a cross sectional structure of a granular particle of an FeNi ordered alloy contained in a magnetic material illustrated in a first embodiment.
Figure 10:
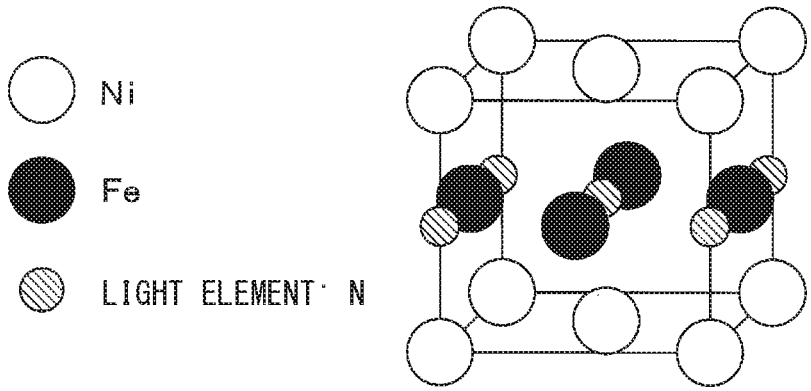
FIG. 10 is a diagram showing a lattice structure of FeNiN being an intermediate product.

The granular particles of the $L1_0$-FeNi ordered alloy have an average particle size of, for example, 40 μm. As shown in FIG. 1A, in the granular particles 1 of the $L1_0$-FeNi ordered alloy, a respective individual granular particle as whole, that is, a whole area of a cross section of a respective individual granular particle has a doped phase in which the light element is incorporated. Alternatively, as shown in FIG. 1B, in the granular particles 1 of the $L1_0$-FeNi ordered alloy, a respective individual granular particle has: a main phase at a center portion 1*a* in which almost no light element is incorporated in the $L1_0$-FeNi; and has the doped phase at a surface layer 1*b* surrounding the center portion 1*a*, wherein the light element is incorporated in the doped phase. Alternatively, as shown in FIG. 10, in the granular particles 1 of the $L1_0$-FeNi ordered alloy, a respective individual granular particle has: the doped phase at the center portion 1*a* in which the light element is incorporated; and has the main phase at the surface layer 1*b* surrounding the center portion 1*a*, wherein almost no light element is incorporated in the main phase.

Figure 2A:
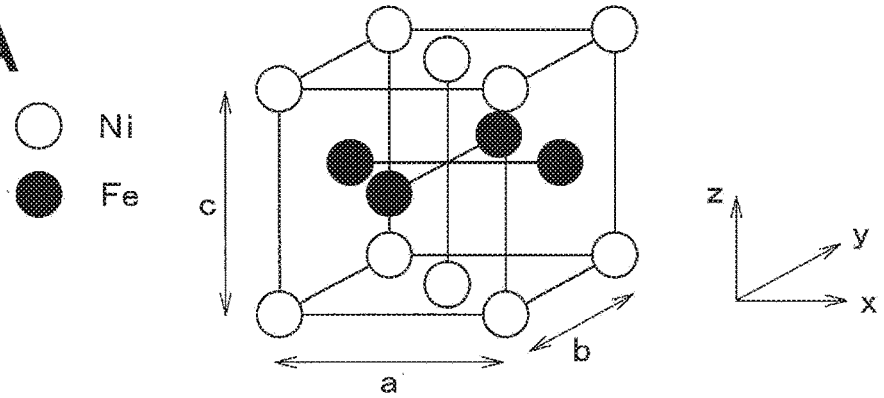
FIG. 2A is a diagram showing a lattice structure of FeNi ordered alloy.

The $L1_0$ regular structure is a structure based on a face-centered cubic lattice, and has a lattice structure as shown in FIG. 2A. In this drawing, the uppermost layer in the layered structure of the [001] plane of the face-centered cubic lattice is an Ni layer in which Ni is mainly present (hereinafter simply referred to as Ni layer). The intermediate layer located between the uppermost layer and the lowermost layer is an Fe layer in which Fe is mainly present (hereinafter simply referred to as an Fe layer).

Figure 2B:
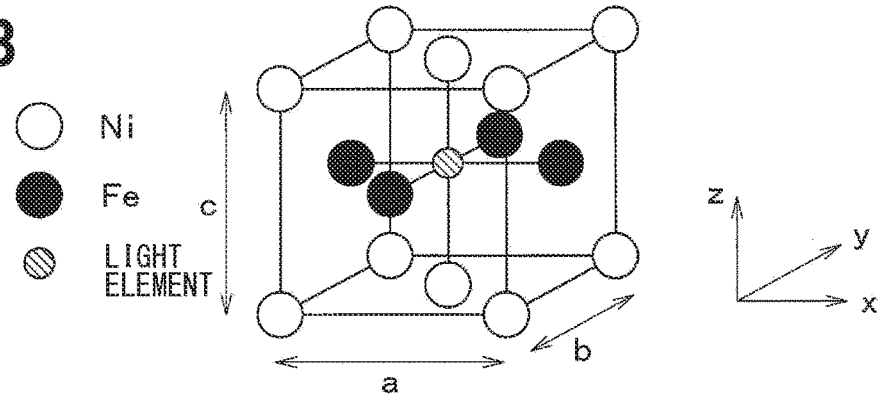
FIG. 2B is a diagram showing a state in which an light element is incorporated in an Fe layer of FeNi ordered alloy.
Figure 2C:
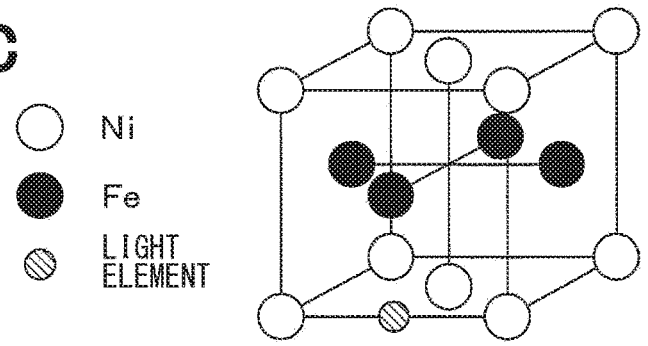
FIG. 2C is a diagram showing a state in which an light element is incorporated in an Ni layer of FeNi ordered alloy.

In the $L1_0$-FeNi ordered alloy having such a structure, as shown in FIG. 2B, the light element is incorporated at octahedral center site in the Fe layer, that is, the center position between Fe atoms. Similarly, as shown in FIG. 2C, the light element is incorporated at the octahedral center site in the Ni layer, that is, the center position among the Ni atoms. It has been confirmed that when the light element is incorporated into the Fe layer or Ni layer, the coercivity increases as compared with an $L1_0$-FeNi ordered alloy in which no light element is incorporated.

Therefore, the $L1_0$-FeNi ordered alloy contained in the magnetic material according to the present embodiment is provided as the granular particle 1 as shown in FIGS. 1A to 10, while the whole of or the surface layer 1*b* of the respective granular particle 1 has the doped phase in which the light element is incorporated. With such structures, the coercivity of the magnetic material including the $L1_0$-FeNi ordered alloy is increased.

Figure 3:
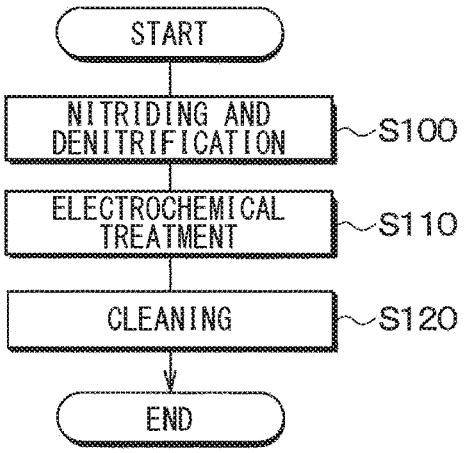
FIG. 3 is a flowchart showing details of a doping process.

This magnetic material with the $L1_0$-FeNi ordered alloy according to the present embodiment may be obtained, for example, by performing a light element doping process on the $L1_0$-FeNi ordered alloy; however, the magnetic material is obtained by performing various processes according to the flowchart shown in FIG. 3.

First, as shown in step S100, an FeNi disordered alloy is prepared, and a nitriding and denitrification treatment is performed thereon to obtain an $L1_0$-FeNi ordered alloy. Specifically, after performing a nitriding treatment of nitriding the FeNi disordered alloy, a denitrification treatment of removing nitrogen from the nitrided FeNi disordered alloy is performed to obtain an FeNi ordered alloy. Here, a random alloy is an alloy in which an arrangement of atoms has no order and is random.

Subsequently, as shown in step S110, the obtained FeNi ordered alloy is subjected to an electrochemical treatment, thereby performing a light element doping process. Specifically, the light element doping process is performed by bonding, carbonizing, and nitriding by the electrochemical treatment. Then, as shown in step S120, a cleaning treatment is performed on an as-needed basis. In this way, it is possible to manufacture the magnetic material with the $L1_0$-FeNi ordered alloy according to the present embodiment.

Figure 4:
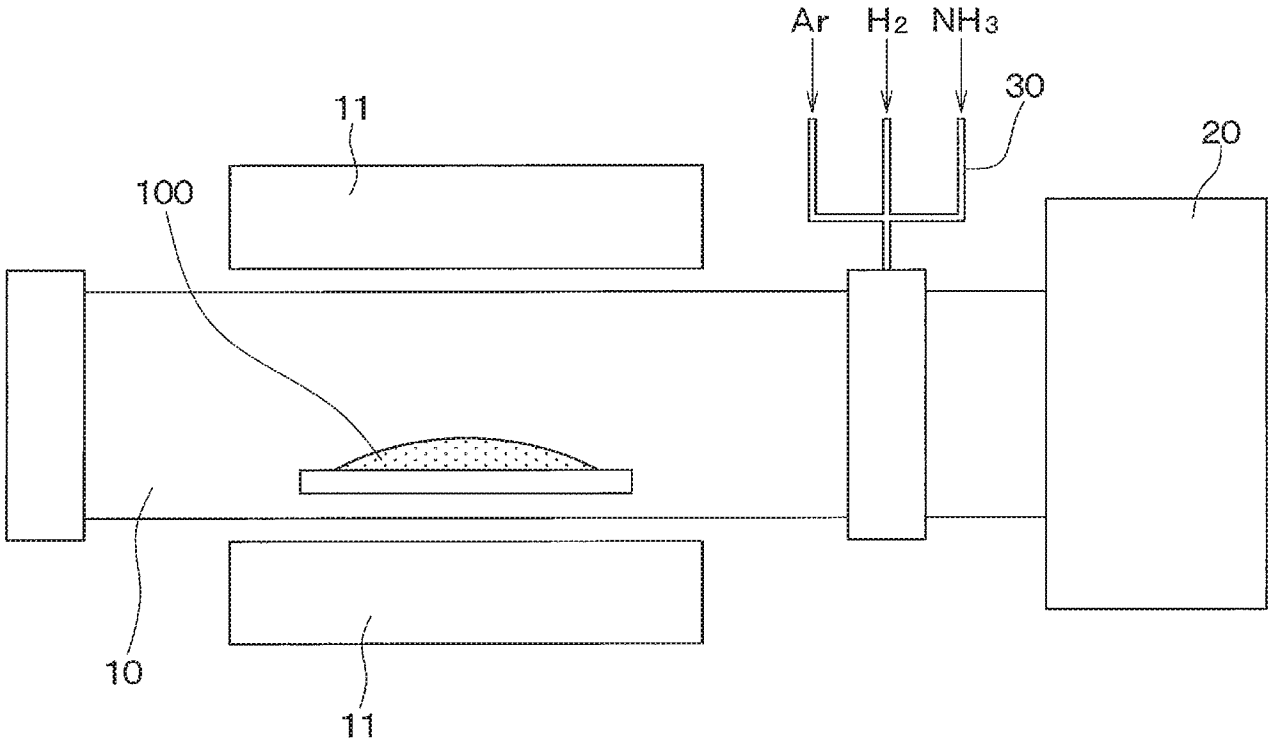
FIG. 4 is a diagram schematically showing a manufacturing apparatus of an FeNi ordered alloy.

Specifically, the nitriding treatment and the denitrification treatment may be performed using, for example, a nitriding and denitrification treatment apparatus shown in FIG. 4. This nitriding and denitrification treatment apparatus includes: a tubular furnace 10 as a heating furnace heated by a heater 11; and a glove box 20 for placing a sample in the tubular furnace 10. As shown in FIG. 4, the nitriding and denitrification treatment apparatus also includes a gas-introducing part 30 which switches over the gas introduced to the tube furnace 10 from among Ar (argon) serving as a purge gas, $NH_3$ (ammonia) for the nitriding treatment and $H_2$ (hydrogen) for the denitrification treatment.

The nitriding and denitrification treatment using such a nitriding and denitrification treatment apparatus is as follows. First, a powder sample of FeNi random alloy 100 is placed in the tube furnace 10. In the nitriding treatment, the $NH_3$ gas is introduced to the tube furnace 10 to have the inside of the tube furnace 10 an $NH_3$ atmosphere, and the FeNi random alloy is heated at a predetermined temperature for a predetermined period to perform the nitriding. At this time, N is incorporated into FeNi by the nitriding treatment, and crystal ordering occurs. Preferably, when FeNiN being an FeNi compound is generated, the structure of a metal element arrangement of the FeNi ordered alloy is obtainable at the stage of the nitriding treatment.

Then, in the denitrification treatment, $H_2$ gas is introduced to the heating furnace to have the inside of the tube furnace 10 an $H_2$ atmosphere, and the nitrided FeNi random alloy is heated at a predetermined temperature for a predetermined period to remove nitrogen. By removing the nitrogen in this manner, an $L1_0$-FeNi ordered alloy in a state before the light element is doped is obtained.

Figure 5:
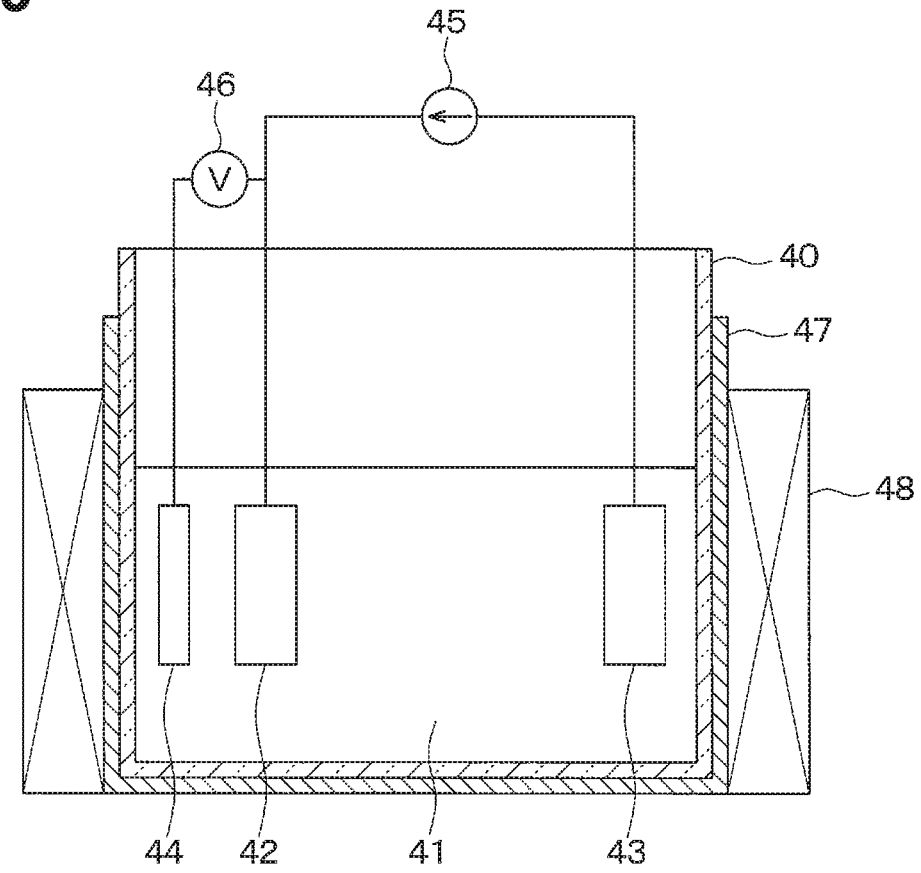
FIG. 5 is a diagram schematically showing a dope apparatus used in a doping process.

The doping process may be performed using, for example, a dope apparatus shown in FIG. 5. In this dope apparatus, a molten salt 41 is filled in a container 40 capable of storing liquid, and the doping of the light element is performed by applying a predetermined voltage via a DC power supply 45 in a state where a working electrode 42, a counter electrode 43 and a reference electrode 44 are immersed in the molten salt 41.

The molten salt 41 is a solution in which a light element doping source is dissolved, has ions of the doping source. By causing the working electrode 42 to absorb the icons, the light element is doped to the working electrode 42. The molten salt 41 is used for the doping source of various light elements such as B, C, and N. For example, $K_2O_3$ or $KBF_4$ is usable as the doping source of B. $K_2OO_3$, $CaC_2$ or the like is usable as the doping source of C. $Li_3N$, $NH_4Cl$, or the like is usable as the dope source of N. As the molten salt 41 to melt these, an alkali metal halide is usable. The alkali metal halide used may be LiF, NaF, KF, CsF, LiCl, NaCl, KCl, CsCl, LiBr, NaBr, KBr, CsBr, LiI, NaI, KI, CsI, or the like. A combination of two or more among these may be used. For example, lithium chloride-potassium chloride-cesium chloride (LiCl—KCl—CsCl), lithium fluoride-sodium fluoride-potassium fluoride (LiF—NaF—KF), or lithium bromide-potassium bromide-cesium bromide (LiBr—KBr—CsBr) may be used. As for a plurality of kinds of light element doping sources, a combination of the above-described materials of the light element doping source may be used. For example, lithium chloride-potassium chloride-cesium chloride-potassium borofluoride-potassium carbonate (LiCl—KCl—CsCl—$KBF_4$—$K_2CO_3$) may be used as a doping source for B and C.

The working electrode 42 is, for example, a flat metal made of the material to be doped with the light element, that is, the $L1_0$-FeNi ordered alloy before doped. Since the $L1_0$-FeNi ordered alloy is provided as the granular particles 1, these are solidified into a plate shape. Further, although the $L1_0$-FeNi ordered alloy is used here, a compound having the same metal element arrangement as the $L1_0$-FeNi ordered alloy, for example, the above-described FeNiN may be used as it is.

The counter electrode 43 is, for example, a flat metal made of metal different than the working electrode 42, for example, made of Al (aluminum).

The reference electrode 44 provides a reference point for measuring an equilibrium potential between the reference electrode 44 and the working electrode 42, and is made of a material having stability, for example, silver-silver chloride. A voltmeter 46 is provided between the reference electrode 44 and the working electrode 42, and the equilibrium potential is measured by the voltmeter 46.

Based on the equilibrium potential measured by the voltmeter 46, the DC power supply 45 generates, between the working electrode 42 and the counter electrode 43, a potential difference exceeding the electrolytic potential at which the ions serving as the light element doping source contained in the molten salt 41 are adsorbed to the working electrode 42. The voltage generated by the DC power supply 45 and the direction of this voltage, that is, the polarity, are controllable, and are controlled based on the magnitude of the equilibrium potential measured by the voltmeter 46.

Since the positive and negative polarities of the equilibrium potential are basically determined according to the materials of respective electrodes, the direction of the voltage generated by the DC power supply 45 may be set according to the materials of respective electrodes, and the magnitude of the voltage may be set based on the equilibrium potential measured by the voltmeter 46. For example, when the molten salt 41 contains $KBF_4$ serving as the B doping source, due to $KBF_4$ to $K^+$+$BF_4^-$, the direction of the voltage of the DC power supply 45 is set so that the working electrode 42 becomes positive. Further, in the cases of the molten salt 41 comprising $Li_3N$ serving as the N doping source, due to $Li_3N$ to 3Li++$N^3$—, the direction of the voltage of the DC power supply 45 is set so that the working electrode 42 becomes negative.

The container 40 is accommodated in a core tube 47 defining an inner wall, and the molten salt 41 is heatable by a temperature adjusting heater 48 disposed around the core tube 47.

Using this dope apparatus, the working electrode 42, the counter electrode 43 and the reference electrode 44 are immersed in the molten salt 41, and the molten salt 41 is heated to 300 to 500 degrees Celsius (C) by the heater 48. Based on the equilibrium potential measured by the voltmeter 46, a desired voltage is applied by the DC power supply 45. As a result, the ions of the doping source contained in the molten salt 41 are adsorbed to the working electrode 42 and are doped into the working electrode 42. In this way, the light element is doped into the $L1_0$-FeNi ordered alloy. Thereafter, on an as-needed basis, the working electrode 42 is cleaned, and thereby, the magnetic material with the $L1_0$-FeNi ordered alloy according to the present embodiment is obtained. The $L1_0$-FeNi ordered alloy obtained in the above has a plate shape being an aggregate of the granular particles 1, and thus, the $L1_0$-FeNi ordered alloy obtained in the above is provided as the granular particles.

Figure 6:
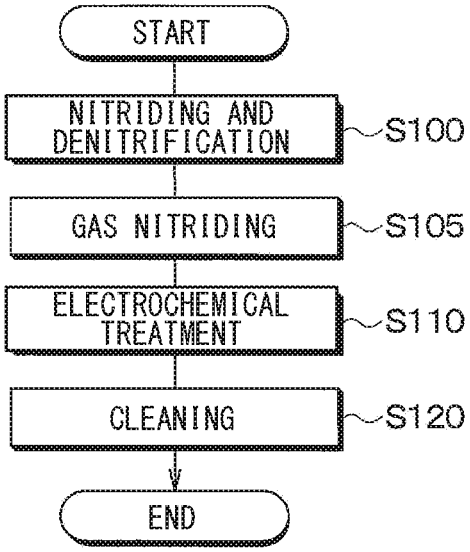
FIG. 6 is a flowchart showing details of a doping process.

The doping process may be performed by gas treatment in place of or in addition to the electrochemical treatment. Specifically, with regard to N, an $L1_0$-FeNi ordered alloy may be nitrided by gas nitriding. For example, as shown in the flowchart of FIG. 6, in step S100, after the nitriding and denitrification treatment similar to that in FIG. 3 is performed, the gas nitriding is performed in step S105. The gas nitriding treatment here may be performed using a nitriding and denitrification treatment apparatus shown in FIG. 4 under the same conditions as the nitriding treatment in step S100. Further, in step S110, the same electrochemical treatment as in FIG. 3 is performed. At this time, N may be doped by the electrochemical treatment; however, since doping of N has already been performed in step S105, only doping of B and C may be performed. Thereafter, in step S120, the magnetic material with the $L1_0$-FeNi ordered alloy according to the present embodiment may be obtained by performing a cleaning treatment on an as-need basis.

As described above, it is possible to nitride the $L1_0$-FeNi ordered alloy by the gas nitriding. Therefore, in the flowchart shown in FIG. 6, in the doping process, the electrochemical process shown in step S110 may not be performed, and only the gas nitriding treatment may be performed.

Next, the saturation magnetization and coercivity of the $L1_0$-FeNi ordered alloy according to the present embodiment obtained by the above manufacturing method will be described by referring to working examples 1 to 8 and a comparative example 1 shown in FIG. 7.

The working examples 1 to 8 in FIG. 7 show the cases where magnetic materials with an $L1_0$-FeNi ordered alloy were manufactured through respective steps according to the flowchart of FIG. 3 or FIG. 6. The comparative example 1 shows a case where a magnetic material with an $L1_0$-FeNi ordered alloy was manufactured without performing a step shown in the flowchart of FIG. 3 or FIG. 6, specifically, without performing the doping process. FIG. 7 is a graph showing the values of saturation magnetization and coercivity in respective cases of the working examples 1 to 8 and the comparative example 1. For the working examples 1 to 8, the conditions of respective steps are also shown in the drawing. Using a small-sized refrigerant-free PPMS VersaLab made by Quantum Design, the magnetic characteristics were obtained with, for example, a magnetic field sweep rate of 10 [Oe].

As shown in FIG. 7, the working examples 1, 2, and 4 were obtained by performing each step shown in the flowchart of FIG. 3. In the doping process for a respective working example 1, 2, and 4, the electrochemical treatment was performed for 20 hours using any one of the doping sources of B, C, and N. In the working examples 1, 2, and 4, the coercivity was, respectively, 88 [kA/m], 95 [kA/m], and 101 [kA/m], and the magnetic saturation was 1.0 [T] in all of them.

In the working example 3, only the gas nitriding treatment in S105 was performed for the doping process in the flowchart of FIG. 3. The gas nitriding treatment was performed for 4 hours. In the working example 3 also, the saturation magnetization was 1.1 [T] and the coercivity was 105 [kA/m].

In the working example 5, the respective steps shown in the flowchart of FIG. 3 were performed. In the doping process of the working example 5, the electrochemical treatment was performed for 20 hours using any two of the doping sources of B, C, and N, specifically, the doping source of a combination of B and C. In working example 5, the saturation magnetization was 1.2 [T], and the coercivity was 96 [kA/m].

In the working examples 6 and 7, each step shown in the flowchart of FIG. 6 was performed. In the doping processes of the working examples 6 and 7, after the gas nitriding, the electrochemical treatment using the doping source of B or C was performed for 20 hours. In both cases of the working examples 6 and 7, the saturation magnetization was 1.0 [T] or more, and the coercivity was 99 and 110 [kA/m], respectively.

In the working example 8, each step shown in the flowchart of FIG. 6 was performed. In the doping process of the working example 8, after the gas nitriding, the electrochemical treatment using the doping source of B and C was performed for 20 hours. In the working example 8, the saturation magnetization was 1.0 [T], and the coercivity was 114 [kA/m].

On the other hand, in the case of the comparative example 1 where neither the gas treatment nor the electrochemical treatment was performed, the saturation magnetization was a large value of 1.4 [T] but the coercivity was a small value of 72 [kA/m].

As shown in the working examples 1 to 8, by performing the doping process by the gas treatment or the electrochemical treatment, the magnetic material with the $L1_0$-FeNi ordered alloy doped with the light element such as B, C, and N is obtained, which achieves both large saturation magnetization and large coercivity.

Further, in the working examples 1 to 3 and the comparative example 1, a dope ratio of the doping element in the obtained magnetic material with the $L1_0$-FeNi ordered alloy was examined. In order to confirm that the doping elements were uniformly doped, the dope ratio in the working example 1 was measured at a plurality of measurement points (1) to (4). FIG. 8A to 8D show the measurement results. The dope ratio was measured using an SEM/EDS which is a scanning electron microscope (hereinafter referred to as SEM) attached with an energy dispersive X-ray analyzer (hereinafter referred to as EDS). The numerical value in the drawing represents the element ratio of each sample measured by the SEM/EDS.

As shown in FIG. 8A, in the working example 1, the element B was present at a ratio of 58% or more at any of the measurement points (1) to (4). This shows that the element B was accurately and evenly incorporated into the magnetic material with the $L1_0$-FeNi ordered alloy. Further, as shown in FIG. 8B, in the working example 2, the element C is present at a ratio of 39%, and this shows that as in the working example 1, the element C is accurately incorporated into the magnetic material with the $L1_0$-FeNi ordered alloy. Further, as shown in FIG. 8C, in the working example 3, the element N is present at a ratio of 43%, and this shows that as in the working examples 1 and 2, the element N is accurately incorporated in the magnetic material with the $L1_0$-FeNi ordered alloy. On the other hand, as shown in FIG. 8D, in the comparative example 1, the ratio of the element B or the like is 0%, and this shows that only Fe and Ni are present in the magnetic material with the $L1_0$-FeNi ordered alloy.

Figure 9:
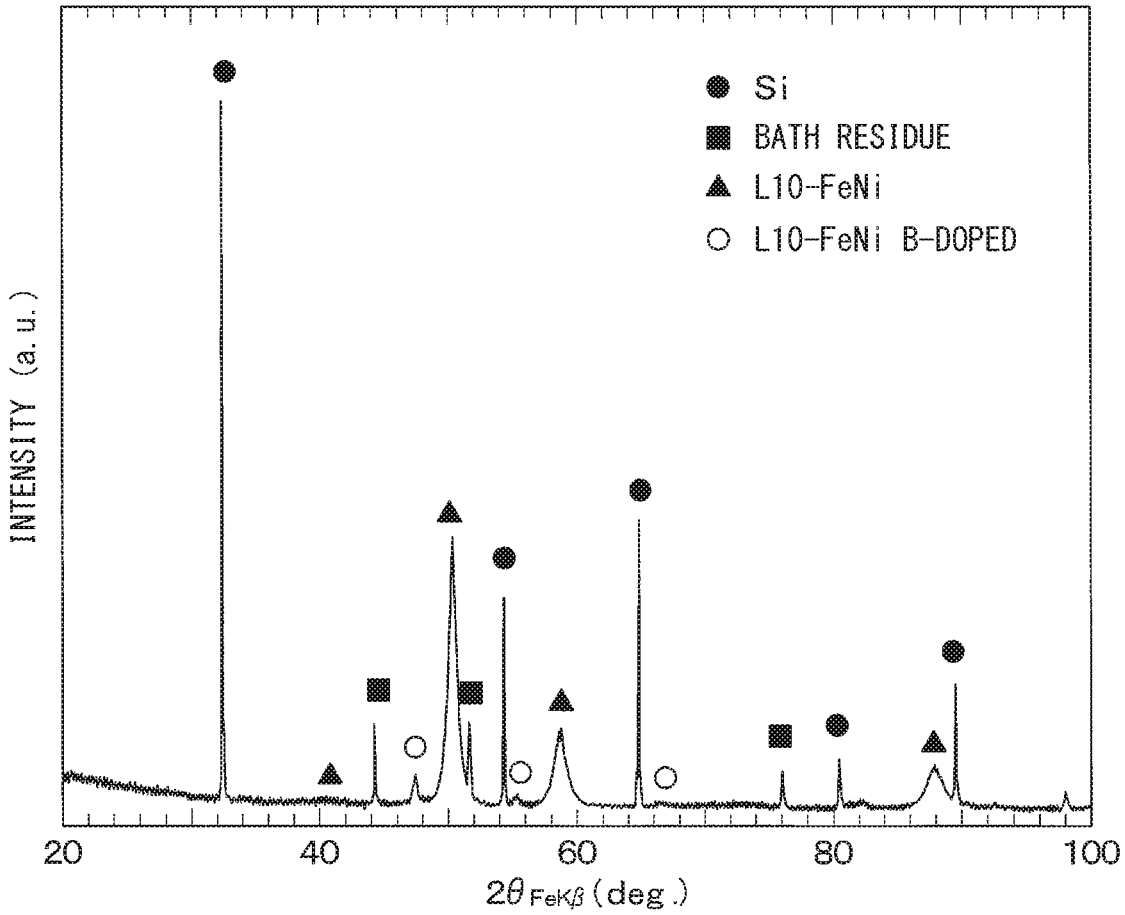
FIG. 9 is a diagram showing a measurement result of an X-ray diffractometer (also referred to hereinafter as XDR).

Moreover, the measurement by XRD was performed on the working example 1. FIG. 9 shows the XRD measurement results. This XRD measurement results show that there were two components, an $L1_0$-FeNi phase and a B-doped phase, and that a compound of an $L1_0$-FeNi ordered alloy, that is, a boride was generated. Thus, by forming a compound by doping the light element such as B, it is possible to obtain a magnetic material with an $L1_0$-type FeNi ordered alloy that achieves both large saturation magnetization and large coercivity.

Furthermore, when the volume ratio of each element was investigated in the working example 1, it was found that the ratio of $L1_0$-FeNi phase to the B doped phase was 95:5. Based on this result and the average particle size 40 μm of the granular particles 1 of the $L1_0$-type FeNi ordered alloy, the thickness of the B-doped phase from the particle surface was 3 μm as a result of calculation. That is, it was confirmed in the working example 1 that the center portion 1*a* of a respective granular particle 1 of the $L1_0$-type FeNi ordered alloy was the main phase in which almost no B was incorporated, and that its surface layer 1*b* was the B-doped phase. Thus, even if the surface layer 1*b* is mainly doped with the light element, it is possible to obtain a magnetic material with an $L1_0$-type FeNi ordered alloy that achieves both large saturation magnetization and large coercivity. The ratio and thickness of the doped phase are adjustable according to the conditions of the doping process. It is possible to obtain a large coercivity by providing the doped phase to not only the surface layer 1*b* but also the entire granular particle 1.

As described above, the $L1_0$-FeNi ordered alloy included in the magnetic material according to the present embodiment is provided as the granular particle 1 and doped with the light element. Specifically, the $L1_0$-FeNi ordered alloy has a structure in which, for example, B, C, and N are incorporated as the light element in the octahedral center site of the Ni layer or the octahedral center site of the Fe layer. With this structure, a magnetic material with an $L1_0$-type FeNi ordered alloy having a coercivity of 87.5 [kA/m] or more and a saturation magnetization of 1.0 [T] or more is obtainable. When not only some of the granular particles 1 constituting the magnetic material but also the granular particles 1 as a whole have the structure as shown in FIGS. 1A to 10, it is possible to obtain larger coercivity and larger saturation magnetization. Of course, if only some of the granular particles 1 constituting the magnetic material has at least one structure shown in FIGS. 1A to 10 and there is the $L1_0$-FeNi ordered alloy not doped with the light element, it is possible to obtain high coercivity and high saturation magnetization. However, when the granular particles 1 as a whole have the structure shown in FIGS. 1A to 10, larger coercivity and larger saturation magnetization are obtainable.

Second Embodiment

A second embodiment will be described. In the present embodiment, a magnetic material comprising an $L1_0$-FeNi ordered alloy doped with a light elements is manufactured by a manufacturing method different than the first embodiment.

Specifically, in the first embodiment, after performing the nitriding treatment and the denitrification treatment, the doping process is further performed to dope the light element into the $L1_0$-type FeNi ordered alloy. In the present embodiment on the other hand, the $L1_0$-FeNi ordered alloy doped with the light element is manufactured, by adjusting the conditions of the denitrification treatment so that the light element N remains, wherein the denitrification treatment is performed after the nitriding treatment.

First, as in the first embodiment, the NeNi disordered alloy is prepared, and the nitriding is performed using the nitriding and denitrification treatment apparatus shown in FIG. 4, so that N is incorporated into FeNi and the crystal ordering occurs. Thereby, FeNiN being an FeNi compound is generated as an intermediate product. The FeNiN has a crystal structure as shown in FIG. 10, and has a lattice structure in which the element N is arranged between the elements Fe in the Fe layer so as to be adjacent to the element Fe.

Thereafter, as the denitrification treatment using the nitriding and denitrogenating apparatus, the denitrification treatment is performed under such conditions that the denitrification is performed more slowly than in the first embodiment. Here, in the $H_2$ atmosphere, the denitrification treatment is performed at the atmosphere temperature of 150 to 400 degrees Celsius (C), e.g., 250 degrees Celsius (C) for the treatment time of 0.1 to 7 hours. The $H_2$ atmosphere is generated by introducing $H_2$ gas to Ar serving as the purge gas, and the ratio of the $H_2$ atmosphere is set to 5% or more.

The treatment temperature, the treatment time, and the ratio of the $H_2$ atmosphere are adjustable as appropriate and has the following relationships: as the treatment temperature is higher, the treatment time is shorter; and the treatment temperature is lower or the treatment time is shorter, the larger ratio of the $H_2$ atmosphere is usable. Here, although a range based on the experiments is shown, the treatment temperature, the treatment time, and the ratio of the $H_2$ atmosphere may be adjusted based on the above relationships.

Further, so that the denitrification in the denitrification treatment is performed slowly, $NH_3$ used for the nitriding treatment may be introduced at the same time. Further, by: introducing $N_2$ in place of or together with $NH_3$ to generate the nitrogen atmosphere; or providing an atmosphere in which $N_2$ and $H_2$ react to generate $NH_3$, it is possible to prevent an occurrence of the denitrification as compared with cases where $N_2$ is not introduced.

When the slow denitrification is performed under these conditions, separation of nitrogen from FeNiN serving as the intermediate product causes not all of FeNiN to become FeN but $L1_0$-$Fe_2Ni_2N$ is also synthesized to provide a mixed phase of FeNi and $Fe_2Ni_2N$. $L1_0$-$Fe_2Ni_2N$ has the metal element arrangement of the $L1_0$-FeNi ordered alloy and further has a structure in which: N is incorporated at an intermediate position between Fe atoms as shown in FIG. 2B; and nitrogen in part is separated from FeNiN but part of the nitrogen is not separated and remains. The structure of the granular particle 1 of the $L1_0$-FeNi ordered alloy comprising $L1_0$-$Fe_2Ni_2N$ may be the structure as in FIG. 1A where the whole has the $L1_0$-$Fe_2Ni_2N$ or the structure as in FIG. 1B where only the surface has the $L1_0$-$Fe_2Ni_2N$.

Now, the lattice structure and lattice constant of $L1_0$-$Fe_2Ni_2N$ synthesized by the above manufacturing method will be described with reference to $L1_0$-FeNi and the like.

The $L1_0$-FeNi has a lattice structure based on the face-centered cubic lattice shown in FIG. 2A. In $L1_0$-FeNi, when an Ni abundance ratio in the Ni layer is 100% and an Fe abundance ratio in the Fe layer is 100%, the lengths of the x-axis and y-axis in the lattice structure, that is, the distance a and the length b each between Ni atoms are equal to each other to satisfy a=b=0.3576 nm to 0.3582 nm. Further, the length of the z-axis, that is, the distance c between Ni atoms is different from the distance a and is given as c=0.3589 nm to 0.3607 nm.

On the other hand, the $L1_0$-$Fe_2Ni_2N$ has the structure as shown in FIG. 2B, in which N is incorporated at the central position between Fe atoms, and has the same ordered structure as the $L1_0$-FeNi. In the $L1_0$-$Fe_2Ni_2N$, when the Ni abundance ratio in the Ni layer is 100% and the Fe abundance ratio in the Fe layer is 100%, the lengths of the x axis and the y axis in the lattice structure, that is, the distance a and the distance b between Ni atoms are equal to each other to satisfy a=b=0.377 nm. Further, the length of the z-axis, that is, the distance c between Ni atoms is different from the distances a and b and is given as c=0.374 nm. $L1_0$-$Fe_2Ni_2N$ has its specific lattice constants.

As a similar material, there is $Fe_2Ni_2N$ in which N is provide at the body center position of $L1_2$-FeNi. This has a structure similar to the lattice structure of FIG. 2B, but the face center position is not defined, so that it is a cubic crystal and the length of each axis is a=b=c=0.773 nm, and therefore, there is no anisotropy. The Fe layer also contains a lot of Ni, and has a structure in which Fe is ⅔ and Ni is ⅓. A lot of Fe also exist at Ni in the center of the Ni layer, and Fe is ⅓ and Ni is ⅔ in the structure.

Figure 11:
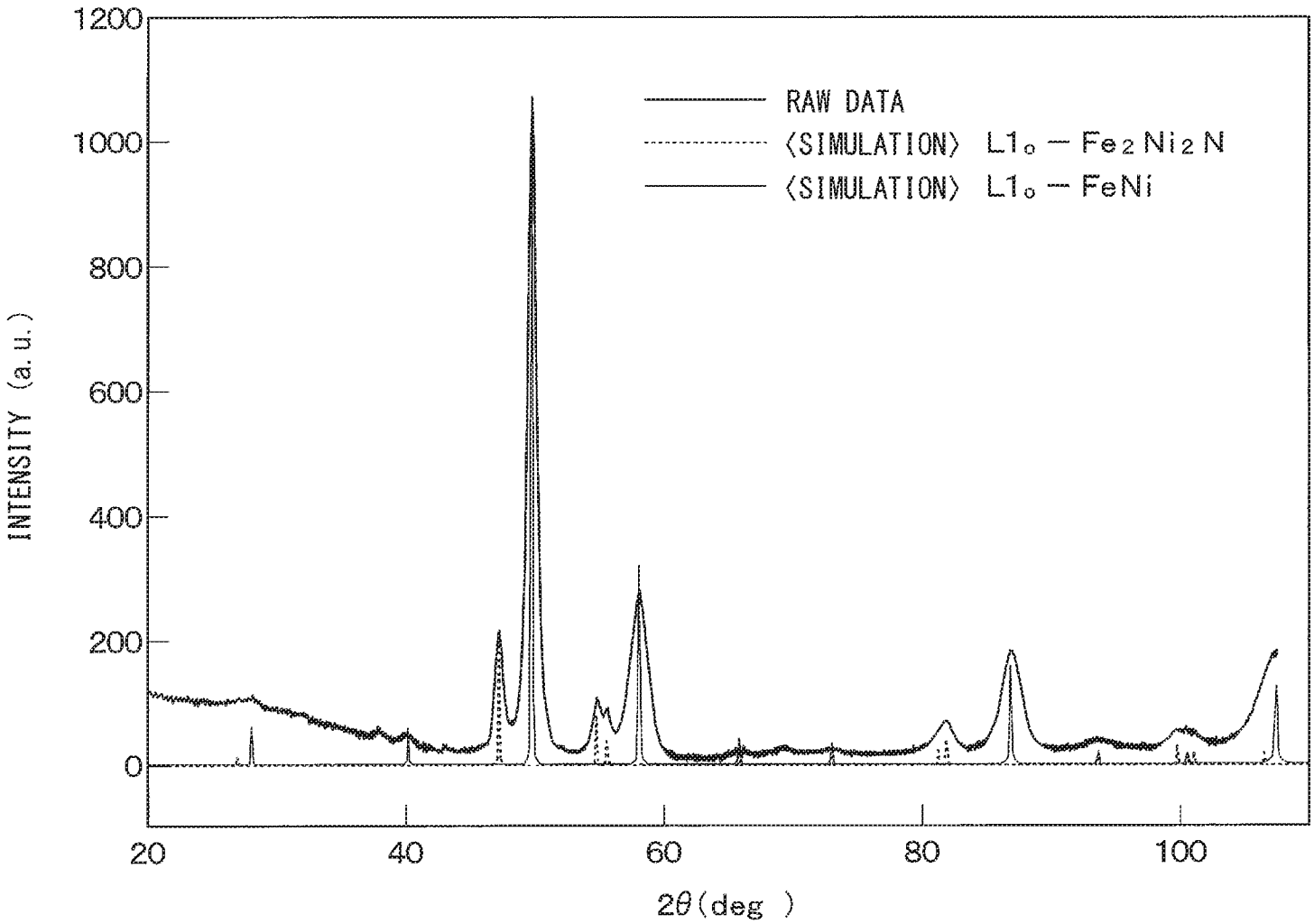
FIG. 11 is a diagram showing a result of X-ray diffraction analysis of an $L1_0$-FeNi ordered alloy contained in a magnetic material according to a second embodiment.

The crystal structure of the $L1_0$-FeNi ordered alloy contained in the magnetic material manufactured by the above manufacturing method was examined by X-ray diffraction. Specifically, an X-ray having a wavelength λ=1.75653 angstroms was incident and a diffraction peak was examined. FIG. 11 shows the results. For reference, the X-ray diffraction investigation of the crystal structures of $L1_0$-$Fe_2Ni_2N$ and $L1_0$-FeNi was also examined by simulations. The result is also shown in FIG. 10. The $L1_0$-$Fe_2Ni_2N$ used in the simulation had the Ni abundance of 100% in the Ni layer is 100% and the Fe abundance of 100% in the Fe layer. Similarly, the $L1_0$-$Fe_2Ni_2N$ used in the simulation had the Ni abundance of 100% in the Ni layer is 100% and the Fe abundance of 100% in the Fe layer.

As can be seen from the simulation result, the $L1_0$-$Fe_2Ni_2N$ and the $L1_0$-FeNi have different diffraction peak values of the incident angle [2θ (deg.)] when X-ray diffraction investigation was made. In particular, in the $L1_0$-$Fe_2Ni_2N$, two peaks appeared in the case of incident angle of around 55 degrees, and the diffraction peak does not occur in the $L1_0$-FeNi. In the $L1_0$-FeNi ordered alloy actually manufactured by the above manufacturing method, two peaks appeared at the incident angle of around 55 degrees. This shows that the $L1_0$-$Fe_2Ni_2N$ exists in the $L1_0$-FeNi ordered alloy manufactured by the above manufacturing method. From this result, it can be said that an $L1_0$-FeNi ordered alloy comprising a doped phase of $L1_0$-$Fe_2Ni_2N$ is successfully made by the above manufacturing method.

Figure 12:
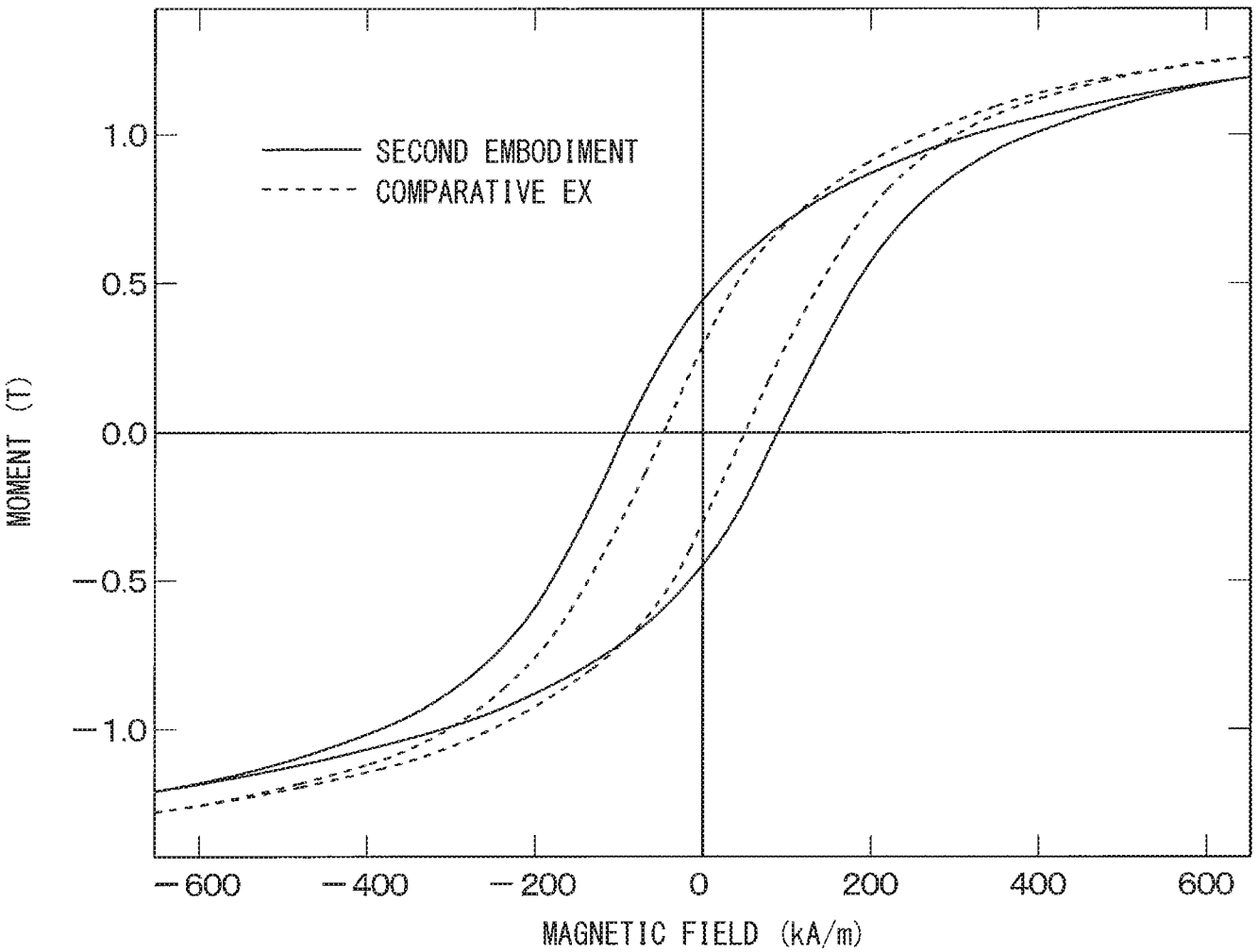
FIG. 12 is a diagram showing a diagram showing measurement results of coercivity.

Further, the coercivity of the $L1_0$-FeNi ordered alloy having a mixed phase of the $L1_0$-FeNi and the $L1_0$-$Fe_2Ni_2N$ of the present embodiment was also examined. FIG. 12 shows the result. As a comparative example, the coercivity of a conventional $L1_0$-FeNi ordered alloy was also examined. The result is also shown in FIG. 12.

As shown in this drawing, in the $L1_0$-FeNi ordered alloy having a mixed phase of the $L1_0$-FeNi and the $L1_0$-$Fe_2Ni_2N$ of the present embodiment, the obtained coercivity was 92 [kA/m], which is larger than 87.5 [kA/m]. Further, in the $L1_0$-FeNi ordered alloy having a mixed phase of FeNi and $Fe_2Ni_2N$ of the present embodiment, the coercivity is increased by 4.5 [kA/m] as compared with the conventional $L1_0$-FeNi ordered alloy. Therefore, by providing an $L1_0$-FeNi ordered alloy comprising $L1_0$-Fe2Ni2N as in the present embodiment, both high coercivity and high saturation magnetization are achievable as in the first embodiment, and the coercivity can be further increased.

Other Embodiments

Although the present disclosure has been described in accordance with the embodiments described above, the present disclosure is not limited to such embodiments but covers various changes and modifications within equivalent ranges. In addition, various combinations and forms, other combinations and forms, including only one, more or less elements, are also within the spirit and scope of the present disclosure.

For example, in the above-described embodiments, the $L1_0$-FeNi ordered alloy provided as the granular particle 1 is obtained by performing the nitriding treatment and the denitrification treatment. However, the $L1_0$-FeNi ordered alloy may be obtained by other than the nitriding treatment and the denitrification treatment. Specifically, after a process of synthesizing a compound in which Fe and Ni are aligned in the same lattice structure as the $L1_0$-FeNi ordered structure, a process of removing unnecessary elements other than Fe and Ni from this compound may be performed to obtain an $L1_0$-FeNi ordered alloy provided as the granular particle 1. Furthermore, a process of synthesizing a compound having the same aligned lattice structures as the FeNi ordered alloy may not be performed.

In the above embodiments, examples of the nitriding treatment and the denitrification treatment are illustrated, and example of the gas nitriding treatment and the electrochemical treatment performed as the doping process are illustrated. However, the conditions illustrated are merely examples. Specifically, as long as a magnetic material comprising an $L1_0$-type FeNi ordered alloy doped with a light element is obtainable, the above illustrated processing examples are not limiting.

Moreover, the above embodiments illustrate the cases where the granular particles 1 constituting the $L1_0$-FeNi ordered alloy have the average particle size of 40 μm and have the thickness of the surface layer 1*b* of 3 μm. However, these are merely examples. The average particle size of the granular particles 1 may be any suitable value, and may be in or may exceed a range of 40 μm+/−10 μm. Furthermore, the thickness of the surface layer 1*b* is not necessarily 3 μm, and may be less or more. As long as the doped phase is formed in at least the surface layer 1*b*, it is possible to ensure large saturation magnetization and large coercivity as in the above embodiments, and the doped phase may be formed throughout the entire cross section of the granular particle 1.

After the denitrification treatment described in the second embodiment is performed, the doping process of introducing B or C as the light element may be performed, and further, the doping process of introducing N by performing the gas nitriding treatment may be performed.

In the second embodiment, in the $L1_0$-$Fe_2Ni_2N$, when the Ni abundance ratio in the Ni layer is 100% and the Fe abundance ratio in the Fe layer is 100%, the distance a and the distance b satisfy a=b=0.377 nm and the distance c satisfies c=0.374 nm. This is directed to an example of $Fe_2Ni_2N$ that has the Ni abundance ratio of 100% in the Ni layer and the Fe abundance ratio of 100% in the Ni layer. However, the Ni abundance ratio in the Ni layer may not be 100% and the Fe abundance ratio in the Ni layer may not be 100%. Even in this case, the distance a is equal to the distance b, and the distance c is different from the distances a and b. Specifically, it may be enough when the a/c is 1.005 or more.

The invention claimed is:

1. A magnetic material comprising an FeNi ordered alloy, the FeNi ordered alloy having an $L1_0$ ordered structure, doped with at least one or more of: B, C, and N, as a light element, and provided as a granular particle, wherein the FeNi ordered alloy having the $L1_0$ ordered structure is an $L1_0$-FeNi ordered alloy, and wherein the granular particle doped with the light element is provided as at least one of:

a granular particle that has a main phase not doped with the light element at a center portion of the granular particle constituting the FeNi ordered alloy and that has a doped phase incorporated with the light element at a surface layer surrounding the center portion; and a granular particle that has a doped phase incorporated with the light element at a center portion of the granular particle constituting the FeNi ordered alloy and that has a main phase not doped with the light element at a surface layer surrounding the center portion.

2. The magnetic material comprising the FeNi ordered alloy, according to claim 1, wherein in addition to the $L1_0$-FeNi ordered alloy provided as the granular particle doped with the light element, the magnetic material further comprises an $L1_0$-FeNi ordered alloy provided as a granular particle not doped with the light element.

3. The magnetic material comprising the FeNi ordered alloy, according to claim 1, wherein:

the $L1_0$-FeNi ordered alloy has a layered structure of [001] plane of a face-centered cubic lattice; and the light element is incorporated at at least one of:

a center position between Ni atoms in a Ni layer in which Ni is mainly present; and a center position between Fe atoms in a Fe layer in which Fe is mainly present.

4. The magnetic material comprising the FeNi ordered alloy, according to claim 3, wherein the magnetic material further comprises an $L1_0$-$Fe_2Ni_2N$ incorporated with N serving as the light element.

5. The magnetic material comprising the FeNi ordered alloy, according to claim 4, wherein the $L1_0$-$Fe_2Ni_2N$ has a tetragonal structure in which distances between Ni atoms being lengths of respective axes constituting a lattice structure are a first distance, a second distance and a third distance that satisfy:

the first distance is equal to the second distance; and the first distance divided by the third distance is 1.005 or more.

6. The magnetic material comprising the FeNi ordered alloy, according to claim 5, wherein the first distance and the second distance are equal to 0.377 nm; and the third distance is equal to 0.374 nm.

7. A magnetic material comprising an FeNi ordered alloy, the FeNi ordered alloy having an $L1_0$ ordered structure, doped with a light element, and provided as a granular particle, wherein the FeNi ordered alloy having the $L1_0$ ordered structure is an $L1_0$-FeNi ordered alloy, the $L1_0$-FeNi ordered alloy has a layered structure of [001] plane of a face-centered cubic lattice, the light element is incorporated at at least one of:

a center position between Ni atoms in a Ni layer in which Ni is mainly present; and a center position between Fe atoms in a Fe layer in which Fe is mainly present, and the magnetic material further comprises an $L1_0$-$Fe_2Ni_2N$ incorporated with N serving as the light element.

8. The magnetic material comprising the FeNi ordered alloy, according to claim 7, wherein the $L1_0$-$Fe_2Ni_2N$ has a tetragonal structure in which distances between Ni atoms being lengths of respective axes constituting a lattice structure are a first distance, a second distance and a third distance that satisfy:

the first distance is equal to the second distance; and the first distance divided by the third distance is 1.005 or more.

9. The magnetic material comprising the FeNi ordered alloy, according to claim 8, wherein the first distance and the second distance are equal to 0.377 nm; and the third distance is equal to 0.374 nm.

* * * * *